US006428342B1

(12) United States Patent
Pan

(10) Patent No.: US 6,428,342 B1
(45) Date of Patent: Aug. 6, 2002

(54) CONDUCTIVE CONNECTING STRUCTURE OF A PIPE-TYPE LAMP

(76) Inventor: Wun Fang Pan, No. 123, No. 99, Pu Din Road, Hsinchu (TW)

( * ) Notice: Subject to any disclaimer, the term of this patent is extended or adjusted under 35 U.S.C. 154(b) by 0 days.

(21) Appl. No.: 09/776,832

(22) Filed: Feb. 6, 2001

(51) Int. Cl.[7] ..... H01R 13/627
(52) U.S. Cl. ..... 439/362; 362/249; 362/252
(58) Field of Search ..... 439/611, 612, 439/617, 618, 362; 362/219, 249, 252, 255, 256, 62

(56) References Cited

U.S. PATENT DOCUMENTS 4,271,458 A * 6/1981 George, Jr. ..... 362/236
4,521,839 A * 6/1985 Cook et al. ..... 362/238
4,607,317 A * 8/1986 Lin ..... 362/249
5,644,189 A * 7/1997 Busby ..... 362/62 X
6,213,048 B1 * 4/2001 Chang ..... 362/249 X

* cited by examiner

*Primary Examiner*—Brian Sircus
*Assistant Examiner*—Son V. Nguyen
(74) *Attorney, Agent, or Firm*—Rosenberg, Klein & Lee

(57) ABSTRACT

The present invention relates to a conductive connecting structure of a pipe-type lamp, which mainly includes a receiver provided at the end of the electrical wire in the pipe-type lamp for conductive connecting with the pin easily. It also provides a clip to engage with the conductive wire of the bulb firmly and conveniently and it is possible to control each bulb being positioned at a same interval for a perfect lighting decorative effect.

3 Claims, 2 Drawing Sheets

CONDUCTIVE CONNECTING STRUCTURE OF A PIPE-TYPE LAMP

BACKGROUND OF THE INVENTION

A conventional pipe-type lamp includes a transparent pipe having electrical wire connecting with several bulbs therein. Normally, it uses the conducting pin to insert into the end of the electrical wire in the pipe-type lamp and the pin contacts with the metal wires of electrical wire directly. It can be found that this prior method would break the inner metal wire of the electrical wire, which is been folded. The conductive effect is not good. Furthermore, the connection between the bulbs in the pipe-type lamp is welded, that seems too inconvenient and easily broken when manufacturing. The distance between each two bulbs is not easily controlled and it may affect the decorative effect. Accordingly, the primary object of the invention is to provide an improved conductive connecting structure of a pipe-type lamp, which has provided with a receiver at the end of the electrical wire and the clip to connect with the bulbs together firmly in ease. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
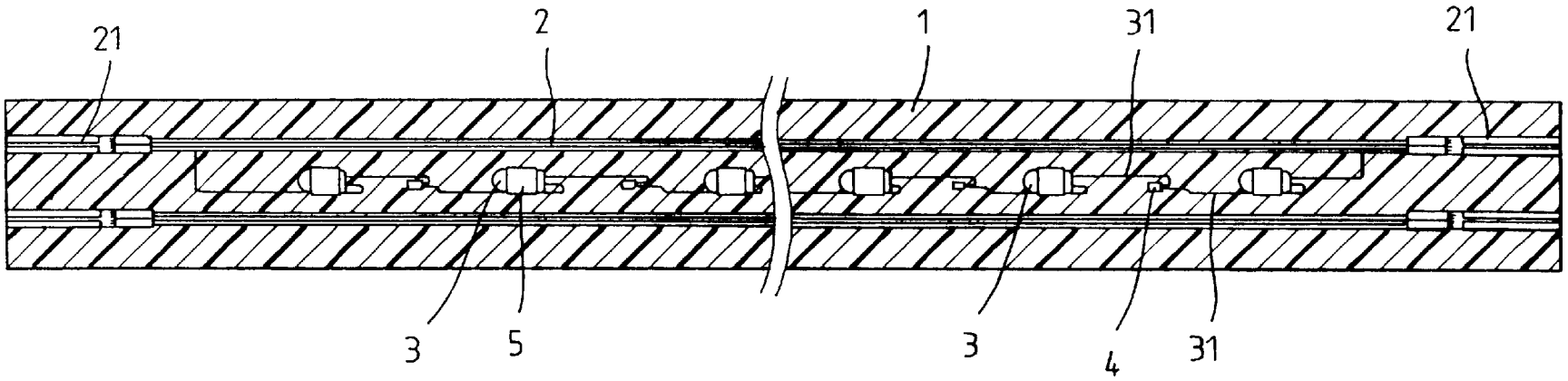
FIG. 1 is a cross-sectional plan view showing a pipe-type lamp according to the present invention.
Figure 2:
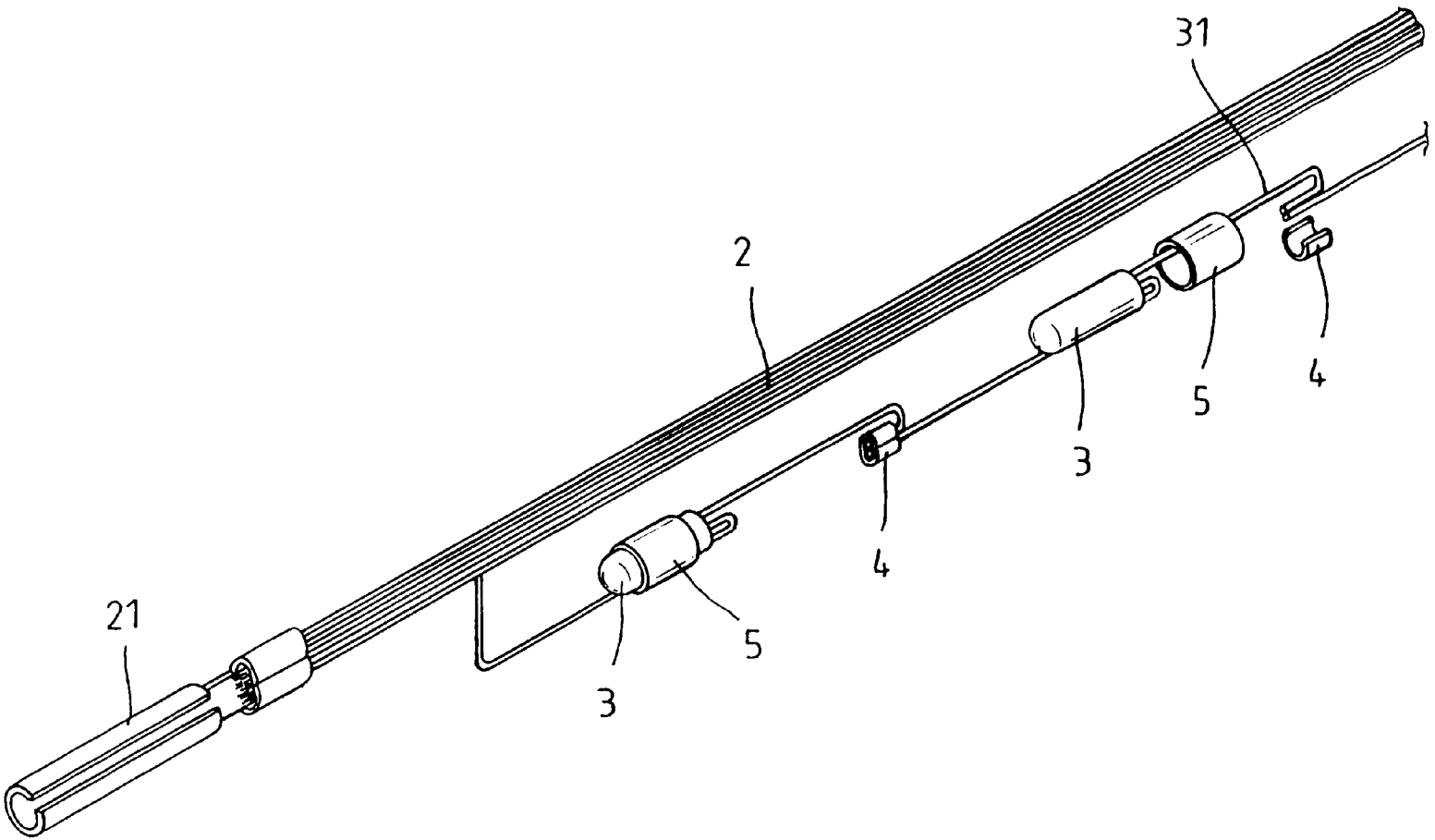
FIG. 2 is a perspective view showing the electrical wire with several bulbs according to the present invention.

Referring to the drawings, the present invention is to provide an improved pipe-type lamp (1) having inner electrical wires (2) and several bulbs (3) in a desired interval. The improvement of this invention is to provide with a receiver (21) connecting with the end metal parts of the electrical wire (2). So it will be very easy to insert the conducting pin into the receiver (21) to obtain a secure conductive connection between the pin and the electrical wire (21). A clip (4) is provided to engage with two conductive wire (31) of every two neighboring bulb (3). By use of the clip (31), the procedure of manufacturing will be more convenient and the interval between the bulbs (3) will be easily controlled for obtaining a promise of quality in lighting decorative effect.

Moreover, It is possible that a transparent ring (5) is provided around the bulb (3) to position the conductive wire (51) along with the bulb (5) for easily manufacturing.

Accordingly, the improved structure of the present invention obtains the effect to manufacture the pipe-type lamp easily. Thus it has excellent practical value in the field. Evidently the invention has the essence of a patent. We hereby apply for a patent grant.

What is claimed is:

1. A pipe-type lamp comprising:

a transparent pipe housing having first and second end portions and an intermediate portion extending therebetween;

at least one electrical wire extending through said intermediate portion of said transparent pipe housing;

a plurality of series coupled bulbs disposed within said intermediate portion of said transparent pipe housing and coupled to said electrical wire, adjacent ones of said bulbs being coupled one to the other by the coupling of conductive wires leading respectively therefrom;

a plurality of transparent rings each disposed coaxially about respective ones of said bulbs to strap thereagainst at least one said conductive wire leading therefrom; and, at least one receiver disposed at each of said first and second end portions of said transparent pipe housing, each said receiver being coupled to said electrical wire and being operable to receive an external conductive member in detachable manner.

2. The pipe-type lamp as recited in claim 1 further comprising a plurality of clips each connecting one with the other said conductive wires respectively leading from adjacent ones of said bulbs.

3. A pipe-type lamp comprising:

an transparent pipe housing having first and second end portions and an intermediate portion extending therebetween;

a series coupled set of a plurality of bulbs disposed within said intermediate portion of said transparent pipe housing, adjacent ones of said bulbs being coupled one to the other by the coupling of conductive wires leading respectively therefrom;

a plurality of clips each connecting one with the other said conductive wires respectively leading from adjacent ones of said bulbs;

a plurality of transparent rings each disposed coaxially about one said bulb to strap thereagainst at least one said conductive wire leading therefrom; and, at least one receiver disposed at each of said first and second end portions of said transparent pipe housing for detachably receiving an external conductive member, each said receiver being electrically coupled to said series coupled set of bulbs.

* * * * *